United States Patent [19]

Goodhues, Jr.

[11] Patent Number: 4,638,920

[45] Date of Patent: Jan. 27, 1987

[54] UNDERGROUND FACILITY FOR STORAGE OF LIQUIDS

[75] Inventor: George S. Goodhues, Jr., 106 Homeland Ave., Baltimore, Md. 21212

[73] Assignee: George S. Goodhues, Jr., Baltimore, Md.

[21] Appl. No.: 624,913

[22] Filed: Jun. 26, 1984

[51] Int. Cl.[4] ..... B65D 25/00

[52] U.S. Cl. ..... 220/445; 220/1 B; 220/5 A; 220/18; 220/85 S

[58] Field of Search ..... 220/445, 1 B, 5 A, 1 B, 220/85 S

[56] References Cited

U.S. PATENT DOCUMENTS

| | | | |
|---|---|---|---|
| 761,548 | 5/1904 | Sheaff . | |
| 1,773,930 | 8/1930 | Athon | 220/5 A |
| 2,362,658 | 11/1944 | Meyer | 220/445 X |
| 2,592,974 | 4/1952 | Sulfrian . | |
| 2,952,380 | 9/1960 | Hampton et al. . | |
| 3,226,467 | 12/1965 | Kienel et al. . | |
| 3,848,765 | 11/1974 | Dürkop | 220/18 X |
| 3,970,863 | 7/1976 | Kishikawa et al. . | |
| 4,065,022 | 12/1977 | Cainaud | 220/1 B X |
| 4,110,947 | 9/1978 | Murray et al. | 220/18 X |

FOREIGN PATENT DOCUMENTS

| | | | |
|---|---|---|---|
| 228717 | 8/1963 | Austria | 220/1 B |

*Primary Examiner*—Steven M. Pollard
*Attorney, Agent, or Firm*—Leonard Bloom

[57] ABSTRACT

An underground storage facility for various liquids, such as gasoline, has a cylindrical storage tank within a substantially rectangular vault. The bottom wall of the vault is inclined downwardly, and any liquid leaking from the tank will run down the bottom wall and accumulate in the lower end of the vault. A vertical pipe is supported within the vault, such that the lower end of the pipe is raised just above the inclined bottom wall of the vault, and such that the upper end of the pipe extends through the vault and above the ground. A rod or other implement may then be inserted into the pipe to detect the accumulation of liquid in the lower end of the vault. The top wall of the vault has a removable manhole cover providing access to the interior of the vault for in situ repairs to the tank. The entire assembly is an integral fabricated structure that is lowered as a unit into the ground.

16 Claims, 5 Drawing Figures

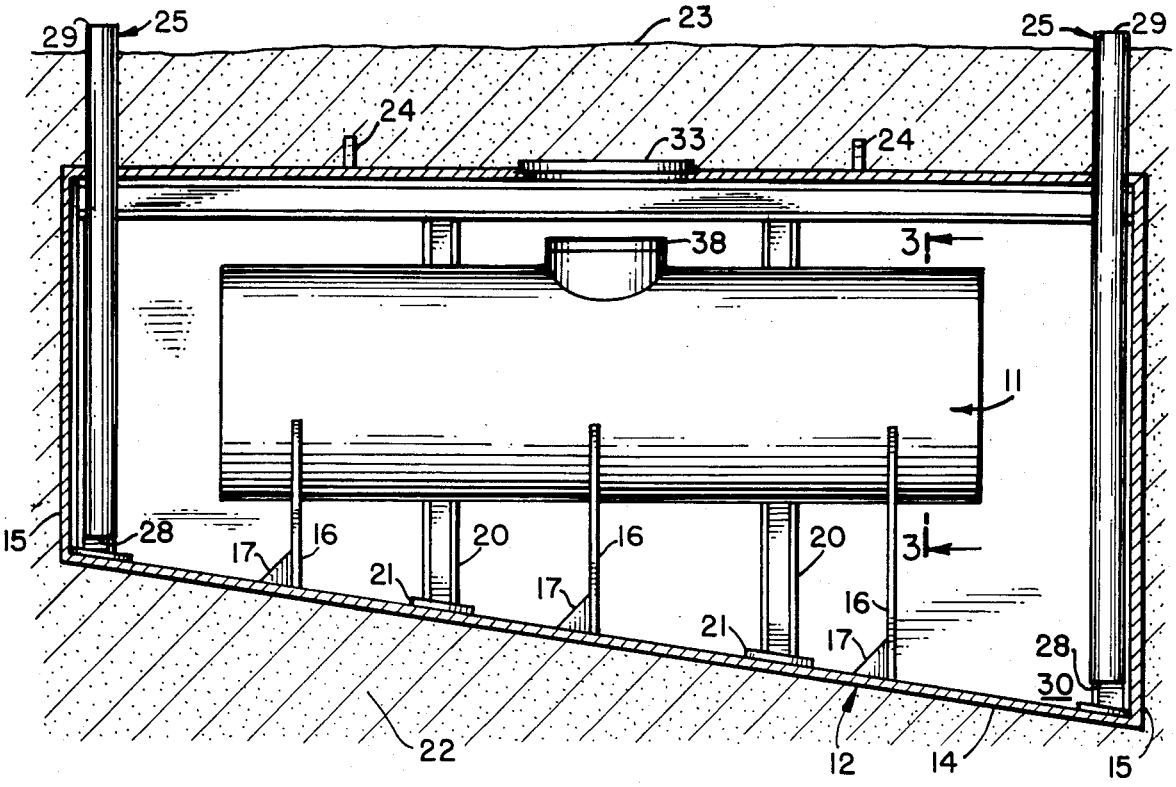
FIG. 2
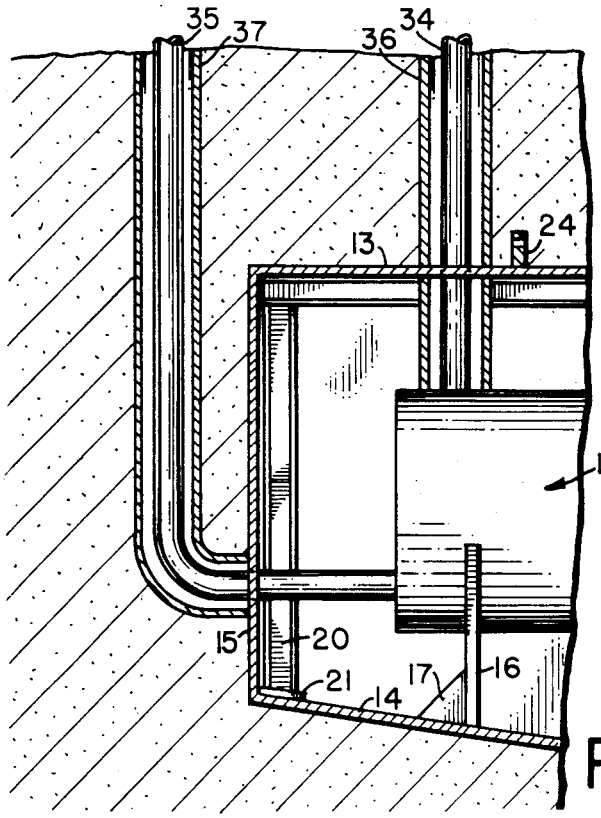
FIG. 4
FIG. 3
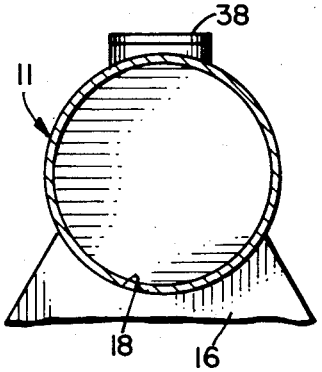

UNDERGROUND FACILITY FOR STORAGE OF LIQUIDS

FIELD OF THE INVENTION

The present invention relates to an underground facility for the storage of liquids and more particularly, to a fabricated unitary structure including a storage tank within a vault, wherein the structure is adapted to be lowered into the ground as a unit and buried therein.

BACKGROUND OF THE INVENTION

In the prior art, underground storage tanks are frequently used for the storage of various liquids, such as gasoline, fuel oil, diesel oil, toxic fluids, or various chemicals. These underground storage tanks are used in automobile service stations, truck and bus depots, for various industrial and commercial facilities, and occasionally, for homes and consumer purposes. The storage tanks are generally cylindrical, consist of a welded construction of sheet steel of sufficient gage, and have a capacity ranging from 550 to 50,000 gallons.

In the event of a crack or fault developing in the tank, the gasoline or other fluid will leak into the ground. Not only is this wasteful, but more importantly, it pollutes the environment. Many of the existing tanks are fairly old, for example twenty-five years old, and the leakage may occur over a relatively long period of time prior to its detection. The tank must then be dug up and removed, either repaired or replaced, and clean-up operations commenced on the surrounding environment. In gasoline stations, especially, the constant vehicular traffic over the buried tanks may cause the tanks to shift and thus become more susceptible to developing cracks and leaks.

The problem may become especially pronounced in suburban or rural areas where the surrounding homeowners depend upon underground wells for an available supply of fresh water. In the event of gasoline leakage, these fresh water supplies may become spoiled or contaminated.

SUMMARY OF THE PRESENT INVENTION

Accordingly, it is an object of the present invention to alleviate the disadvantages and deficiencies of the prior art by providing an underground storage facility which accommodates the detection of leaks, confines the leaks to a closed vault within which the storage tank is housed, and provides for convenient access to the vault for the purpose of making repairs to the tank.

It is another object of the present invention to provide an underground storage facility including a fabricated unitary structure adapted to be lowered into the ground as a unit and buried therein.

It is yet another object of the present invention to provide an underground storage facility including a fabricated unitary structure that may be scaled up (or down) in size to accommodate a wide range of tank sizes, as for example, 550 gallons to 50,000 gallons.

It is a further object of the present invention to provide an underground storage facility having a unitary structure that may be fabricated easily and economically using low-carbon steels which are readily available on the commercial market.

In accordance with the teachings of the present invention, there is disclosed herein a preferred embodiment of an underground facility for the storage of liquids, such as gasoline, which includes a fabricated unitray structure adapted to be lowered into the ground as a unit and buried therein. The structure includes a substantially rectangular vault having a top wall, a bottom wall, and four side walls therebetween. A storage tank is supported within the vault and has an access clearance or space therebetween. At least one vertical pipe is supported within the vault. The pipe has a lower end terminating above the bottom wall and further has an upper end extending through the top wall and above the ground. The pipe thus facilitates the detection of fluid leaks in the tank and into the vault; and the top wall of the vault is provided with an access means to the interior of the vault, such that one or more service personnel may enter the vault to make repairs to the tank, in situ, without the necessity of removing the tank from the ground.

In accordance with the further teachings of the present invention, the bottom wall is inclined downwardly with respect to the top wall of the vault, such that the vault has a lowermost portion at one end thereof for accumulation of leakage from the tank; and the lowermost portion of the vertical pipe terminates just above this lowermost portion. With this arrangement, a rod may be inserted through the pipe to detect and measure the amount of leakage (if any) accumulated in the vault; or in lieu of the rod, any suitable detection means may be employed consonant with the teachings of the present invention.

In accordance with the still further teachings of the present invention, the storage tank is preferably cylindrical; and the means for supporting the tank within the vault includes a plurality of vertical parallel plates secured to the bottom wall and spaced apart from one another, each of the plates having an upper portion formed with a substantially semi-circular recess for cradling the tank. Means are also provided for internal bracing of the fabricated unitary structure so as to assure its structural integrity when being lowered into (or raised out of) the ground. Preferably, this means includes a pair of longitudinal parallel beams secured to the underside of the top wall and further includes a plurality of spaced vertical beams secured between each of the longitudinal parallel beams and the bottom wall of the vault. Access to the vault is provided by means of a removable manhole cover in the top wall of the vault, the cover preferably being disposed in substantial alinement with (and above) a removable lid on the top of the tank. The top wall is also provided with a pair of spaced eyelet means secured thereto, thereby facilitating the attachment of the unitary structure to a crane or the like for lowering the structure into (or raising it above) the ground.

These and other objects of the present invention will become apparent from a reading of the following specification, taken in conjunction with the enclosed drawings.

BRIEF DESCRIPTION OF THE DRAWINGS

FIG. 2 is a stepped section view taken along the lines 2—2 of FIG. 1, showing two of the four vertical detection pipes illustrated at respective corners of the vault.

FIG. 3 is a section view taken along the lines 3—3 of FIG. 2, showing a cylindrical storage tank cradled within one of the vertical support plates secured to the bottom wall.

FIG. 4 corresponds substantially to a portion of FIG. 2, but illustrates the piping into and out of the storage tank.

GENERAL DESCRIPTION OF THE PREFERRED EMBODIMENT

Figure 1:
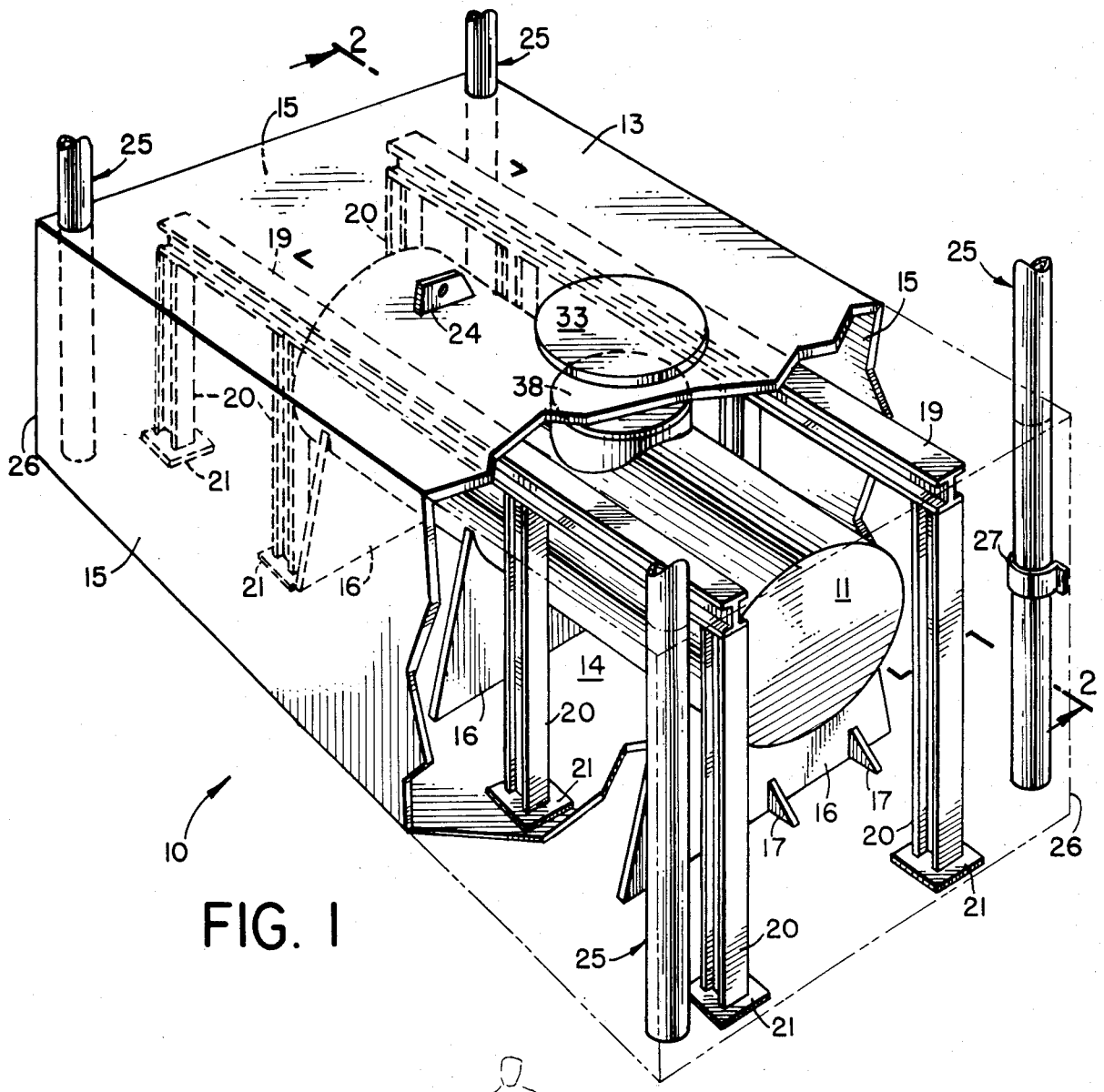
FIG. 1 is a perspective of the complete underground storage facility of the present invention, with certain parts being broken away and sectioned to show the storage tank within the vault, the piping into and out of the tank being omitted for ease of illustration.

With reference to FIGS. 1–3, the underground storage facility of the present invention includes a fabricated unitary structure 10 having a storage tank 11 supported within a closed vault 12 with clearance therebetween. The tank is preferably cylindrical, may have a capacity within the range of 550 to 50,000 gallons, and is adapted for the storage of gasoline, fuel oil, diesel oil, chemicals and various liquids. Preferably, the vault is rectangular and includes a top wall 13, a bottom wall 14, and four side walls 15 therebetween. A plurality of vertical support plates 16, spaced apart from each other, are secured to the bottom wall by respective brackets 17; and each of the support plates has a substantially semi-circular recess 18 for cradling the tank, as shown more clearly in FIG. 3. A pair of spaced longitudinal parallel beams 19, preferably "I" beams, are secured to the underside of the top wall of the vault. A plurality of spaced vertical beams 20 are secured between each of the longitudinal parallel beams and the bottom wall of the vault. The beams 20 are secured to the respective walls and to each other by suitable welds, an preferably a foot plate 21 is secured between the bottom wall and the lowermost end of each vertical beam for increased support. The respective walls 13–15 of the vault are formed from sheet or plate steel of sufficient gage and quality; and the beams 19–20 form a box or frame on which the walls are secured, preferably by suitable welds. With this arrangement, the structural integrity of the assembly is assured. This assembly is preferably all welded and may be fabricated from readily available materials in any steel fabricating facility or suitably equipped shop. If desired, the exterior surfaces of the vault may be provided with a suitable coating to resist corrosion over a substantial period of time. The overall assembly may be lowered into (or raised out of) the ground as a unit; and as shown more clearly in FIG. 2, is buried within the ground 22 to a depth of several feet below the ground surface 23. A pair of spaced eyelets 24 are secured to the top wall to facilitate the attachment of cables to lower the fabricated unitary assembly by means of a crane or other suitable piece of heavy equipment.

A plurality of vertical pipes 25 are mounted within the vault, preferably adjacent to the respective corners 26 thereof, and are supported by suitable brackets, one of which is shown at 27 in FIG. 1. The lower end 28 of each pipe is disposed just above the bottom wall and the upper end 29 of the pipe extends through the top wall of the vault and through the layer of earth and protrudes above the ground surface, as shown in FIG. 2.

Figure 5:
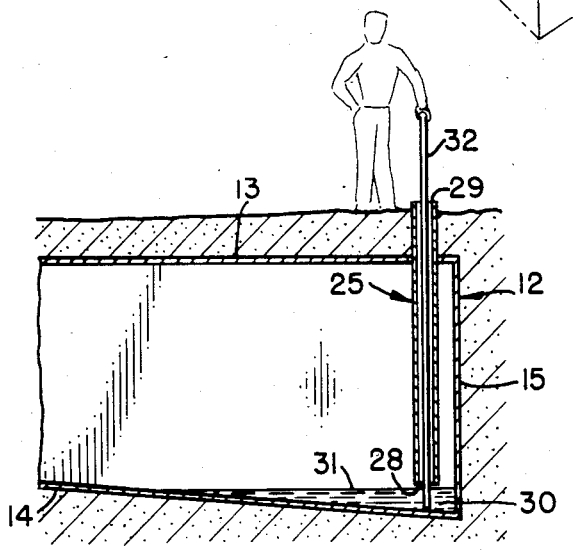
FIG. 5 illustrates how a rod may be used (within one of the vertical pipes) to detect any accummulation of leakage out of the tank and into the vault.

The bottom wall 14 of the vault is preferably inclined downwardly with respect to the top wall 13, such that the vault has a lowermost portion 30 at one end thereof, as shown in FIGS. 2 and 5, for the accumulation of leakage 31 therein in the event of a crack or fault in the tank. Since the cradles 16 and bracing beams 19, 20 are spaced inwardly of the respective side walls of the vault (as shown more clearly in FIG. 1) any liquid leaking out of the tank will flow relatively unimpeded to the lowermost end portion of the vault. The top of each vertical pipe may be covered by a suitable threaded cap (not shown) which may be removed to enable a rod or stick 32 to be inserted into the pipe (or pipes) 25, as shown more clearly in FIG. 5, to detect the presence of any liquid in the lowermost end 30 of the vault. It will be appreciated by those skilled in the art, however, that any suitable detection or alarm means may be provided (such as a whistle) consonant with the teachings of the present invention.

If the end of the stick 32 (when removed from the pipe) shows an accumulation of the stored liquid, a leak has thus been detected. The several feet of earth 22 may then be dug out to expose a removable manhole cover 33 mounted on the top wall 13 of the vault 12. Removal of the manhole cover 33 allows a service person (or persons) to enter into the vault 12 to determine the cause of the leakage problem and to make in situ repairs to the tank 11 without the necessity for digging out the tank and lifting it completely out of the ground. The manhole cover provides access to the vault, and the clearance between the tank and the vault is sufficient for a service person (or persons) to maneuver within the vault.

With reference to FIG. 4, an inlet pipe 34 and an outlet pipe 35 are provided for the tank 11. Preferably, these pipes 34 and 35 are housed within conduits 36 and 37, respectively. The tank is also provided with one or more vent pipes which, being conventional, have been omitted for ease of illustration. The tank is also provided with a removable lid 38 directly below, and substantially in alignment with, the removable manhole cover 33 for the vault.

Accordingly, the present invention provides a commercially-practical underground storage facility for various liquids, such as gasoline. The fabricated unitary structure, including a vault within which the storage tank is supported, may be lowered into the ground as a unit. Any leaks may be detected early on, are confined to the vault, and do not spoil or pollute the environment. The earth may be removed to uncover the top wall of the vault, and the manhole cover may be removed for access to the interior of the vault. The leakage may be pumped out, and in situ repairs may be made to the tank without the necessity for lifting the tank out of the ground.

Obviously, many modifications may be made without departing from the basic spirit of the present invention. Accordingly, within the scope of the appended claims, the invention may be practiced other than specifically disclosed herein.

I claim:

1. An underground facility for the storage of liquids, comprising a fabricated unitary structure adapted to be lowered into the ground as a unit and buried therein, the structure including a substantially rectangular, substantially totally enclosed vault having a top wall, a bottom wall, and four side walls therebetween, the side walls forming respective corners therebetween, a storage tank substantially disposed completely within the vault, the vault and tank having an access clearance therebetween sufficient to accommodate a repair person, spaced means supporting the storage tank within the vault, at least one substantially vertical pipe supported within the vault and disposed substantially adjacent to a respective corner thereof, the pipe having a lower end terminating above the bottom wall, the pipe further having an upper end extending through the top wall and above the ground, the pipe being sufficiently large to suitably accommodate a rod therein, thereby facilitating the detection of leaks from the storage tank into the vault, and the top wall having means therein providing access to the interior of the vault, whereby in situ repairs may be made to the tank, the bottom wall being inclined downwardly with respect to the top wall, wherein the vault has a lowermost portion at one end thereof for accumulation of leakage from the tank, wherein the pipe terminates just above the lowermost portion, and wherein the spaced means supporting the tank within the vault accommodates the relatively unimpeded flow of any leakage from the tank along the inclined bottom wall of the vault to the lowermost portion thereof.

2. The underground facility of claim 1, wherein the vault is provided with four corners, and wherein four vertical pipes are provided, one each adjacent to a respective corner.

3. The underground facility of claim 1, wherein the storage tank is substantially cylindrical and is disposed along a substantially horizontal axis, and wherein the spaced means for supporting the tank within the vault comprises a plurality of vertical parallel plates secured to the bottom wall and spaced apart from one another, each of the plates having an upper portion formed with a substantially semi-circular recess for cradling the tank.

4. The underground facility of claim 1, further including a pair of spaced longitudinal parallel beams secured to the underside of the top wall, and further including a plurality of spaced vertical beams secured between each of the longitudinal parallel beams and the bottom wall of the vault, thereby providing internal bracing for the unitary structure.

5. The underground facility of claim 1, wherein the means providing access to the vault comprises a removable manhole cover in the top wall of the vault.

6. The underground facility of claim 5, wherein the tank has a removable lid disposed in substantial alignment with the removable manhole cover and therebelow.

7. The underground facility of claim 1, further including a pair of spaced eyelet means secured to the top wall, thereby facilitating the attachment of the unitary structure to a crane or the like for lowering the structure into the ground.

8. An underground facility for the storage of liquids, comprising a fabricated unitary structure adapted to be lowered into the ground as a unit and buried therein, the structure including a substantially-rectangular closed vault having a top wall, a bottom wall, and four side walls therebetween, the bottom wall being inclined downwardly with respect to the top wall and having a lowermost portion at one end thereof, a substantially cylindrical storage tank enclosed within the vault, longitudinally thereof, and disposed along a substantially horizontal axis, the vault and tank having an access clearance therebetween sufficient to accommodate a repair person, cradle means for supporting the storage tank within the vault, the side walls of the vault defining therebetween a plurality of corners, at least one pair of vertical pipes supported within the vault substantially adjacent to the respective corners at the lowermost end portion of the inclined bottom wall, each of the pipes having a lower end terminating above the inclined bottom wall and further having an upper end extending through the top wall of the vault and above the ground surface, each of the pipes being sufficiently large to slidably accommodate a rod therein, thereby facilitating the detection of leaks from the storage tank into the vault, bracing means for the vault and including spaced longitudinal beams secured to one of the top and bottom walls and further including a plurality of substantially vertical beams secured between the respective longitudinal beams and the other of the top and bottom walls, the cradle means and the bracing means being spaced sufficiently from the respective side walls of the vault to allow relatively unimpeded flow of leakage along the inclined bottom wall of the vault to the lowermost end portion thereof, and the top wall of the vault having a removable manhole cover therein, whereby in the event of a leak, only the ground just above the manhole cover need be removed, and thereafter the manhole cover may be removed to enable the repair person to enter into the access clearance between the tank and the vault, whereby in situ repairs may be made to the tank.

9. An underground facility for the storage of liquids, comprising a fabricated structure adapted to be lowered into the ground as a unit and to be buried below the ground surface, the structure including a vault means and further including a storage tank means supported and substantially encased completely within the vault means, the vault means and the tank means having an access clearance therebetween sufficient to accommodate a repair person, the vault means including an inclined bottom wall defining a lowermost end portion of the vault means, means including at least one vertical pipe supported within the vault means and extending from just above the lowermost end portion of the vault means to above the ground surface for detecting a leak in the tank, means independent of the tank means for providing access to the interior of the vault means, thereby facilitating an in situ repair of the tank, cradle means for supporting the tank means within the vault means, and bracing means for assuring the structural integrity of the vault means, wherein the cradle means and the bracing means are sufficiently spaced from the respective side walls of the vault means to assure substantially unimpeded flow of any leakage along the inclined bottom wall of the vault means to the lowermost end portion thereof.

10. An underground facility for the storage of liquids, comprising a substantially closed vault means including respective side walls and further including a tank means, cradle means for supporting the tank means within the vault means, the vault means and the tank means having an access clearance therebetween sufficient to accommodate a repair person, bracing means for assuring the structural integrity of the facility, whereby the facility may be lowered into the ground as a unit, and whereby any leakage from the tank means will be substantially confined to the vault means to protect the environment against pollution, the vault means including an inclined bottom wall defining a lowermost end portion of the vault means, wherein the cradle means and the bracing means are spaced sufficiently from the respective side walls of the vault means to assure substantially unimpeded flow of any liquid leaking from the tank means along the inclined bottom wall of the vault means to the lowermost end portion thereof, means for detecting the accumulation of liquid within the lowermost end portion of the vault means due to leakage from tha tank means, and means independent of the tank means for providing access to the vault means, whereby the liquid may be pumped out of the vault means, and whereby the vault means may be entered by a service person to make in situ repairs to the tank means without requiring the tank means to be lifted out of the ground.

11. An underground facility for the storage of liquids, comprising a substantially rectangular vault having top, bottom and end walls, and further having respective side walls defining corners of the vault, a tank disposed along a substantially horizontal axis and substantially enclosed completely within the vault below the top wall thereof, respective cradle means between the bottom wall of the vault and the tank for supporting the tank within the vault, the cradle means being spaced from the respective side walls, the cradle means accommodating relatively unimpeded flow of leakage from the tank along the bottom wall of the vault to the corners thereof, a manhole cover removably mounted in the top wall of the vault above the tank, the tank and the vault having an access clearance therebetween, which is available through the removable manhole cover in the top wall of the vault, and which is substantially all around the tank and is sufficiently large to accommodate a repair person therein, and at least one substantially-straight vertical pipe spaced inwardly adjacent to a respective corner of the vault for detecting leakage from the tank, whereby the leakage may be readily detected and recovered, whereby spillage to the ground surrounding the vault is precluded, and whereby in situ repairs may be made to the tank, all without removing either the tank or the vault from the ground.

12. The underground facility of claim 11, including an inlet pipe and an outlet pipe for the tank, and further including a conduit for housing each of the pipes, the pipes and conduits extending through the walls of the vault, respectively, whereby leakage from the pipes will be confined.

13. The underground facility of claim 11, wherein the bottom wall of the vault is inclined, thereby forming two lowermost corners at one end wall of the vault; and wherein two pipes are provided, one at each lowermost corner, respectively.

14. The underground facility of claim 13, wherein four pipes are provided, one adjacent to each of the corners of the vault, respectively.

15. An underground facility for the storage of liquids, comprising a substantially rectangular vault having top, bottom and end walls, and further having respective side walls, the bottom wall being inclined downwardly to define a lowermost end portion of the vault, a tank disposed along a substantially horizontal axis and substantially enclosed completely within the vault below the top wall thereof, respective cradle means between the bottom wall of the vault and the tank for supporting the tank within the vault, the cradle means being spaced from the respective side walls, the cradle means accommodating relatively unimpeded flow of leakage from the tank along the bottom wall of the vault to the lowermost end portion thereof, a manhole cover removably mounted in the top wall of the vault above the tank, the tank and the vault having an access clearance therebetween, which is available through the removable manhole cover in the top wall of the vault, and which is substantially all around the tank and is sufficiently large to accommodate a repair person therein, and means for detecting the leakage accumulating at the lowermost end portion of the vault, whereby the leakage may be readily detected and recovered, whereby spillage to the ground surrounding the vault is precluded, and whereby in situ repairs may be made to the tank, all without removing either the tank or the vault from the ground.

16. The underground facility of claim 15, wherein the lowermost end portion of the vault comprises a lowermost end corner thereof, and wherein the means for detecting the leakage comprises a substantially-straight vertical pipe mounted in the vault inwardly adjacent to the lowermost end corner thereof, the pipe having a lowermost portion terminating just above the bottom wall of the tank.

* * * * *